US010172383B2

(12) United States Patent
Kida et al.

(10) Patent No.: US 10,172,383 B2
(45) Date of Patent: Jan. 8, 2019

(54) DRYING DEVICE AND CIGARETTE WRAPPING PAPER MANUFACTURING MACHINE USING THE DRYING DEVICE

(71) Applicant: JAPAN TOBACCO INC., Tokyo (JP)

(72) Inventors: Shinzo Kida, Tokyo (JP); Masaaki Fukaya, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 276 days.

(21) Appl. No.: 14/133,207

(22) Filed: Dec. 18, 2013

(65) Prior Publication Data

US 2014/0101960 A1 Apr. 17, 2014

Related U.S. Application Data

(63) Continuation of application No. PCT/JP2011/068467, filed on Aug. 12, 2011.

(51) Int. Cl.

| | |
|---|---|
| ***A24C 5/00*** | (2006.01) |
| ***A24D 1/02*** | (2006.01) |
| ***D21H 27/00*** | (2006.01) |
| ***D21H 19/00*** | (2006.01) |
| ***F26B 13/14*** | (2006.01) |
| ***F26B 13/12*** | (2006.01) |

(52) U.S. Cl.

CPC ..... *A24C 5/005* (2013.01); *A24D 1/02* (2013.01); *A24D 1/025* (2013.01); *D21H 19/00* (2013.01); *D21H 27/00* (2013.01); *F26B 13/12* (2013.01); *F26B 13/14* (2013.01)

(58) Field of Classification Search

CPC ..... F26B 13/14; F26B 13/12

USPC ..... 34/637

See application file for complete search history.

(56) References Cited

U.S. PATENT DOCUMENTS 1,432,729 A * 10/1922 Pinder ..... F26B 3/283 100/304
1,838,480 A * 12/1931 Gangler ..... B31B 19/62 226/111

(Continued)

FOREIGN PATENT DOCUMENTS

CA 2765348 A1 * 1/2011 ..... A24C 5/005
GB 211162 A * 1/1925 ..... B29D 7/00

(Continued)

OTHER PUBLICATIONS

Extended European Search Report issued in corresponding EP Application No. 11870951.8 dated Jun. 26, 2015 (in English).

*Primary Examiner* — Kenneth Rinehart
*Assistant Examiner* — Logan Jones
(74) *Attorney, Agent, or Firm* — Birch, Stewart, Kolasch & Birch, LLP

(57) ABSTRACT

A drying device having a travel path along which a web (W) of paper travels, a plurality of drying ovens arranged side by side along the travel path, a plurality of conveyor rolls provided in each of the drying ovens to convey the web (W) along the travel path, a plurality of roll units each constituted by one or more of the conveyor rolls and separated from each other along the travel path, and a plurality of conveyor motors connected to the respective roll units to rotate the conveyor rolls, wherein a downstream one of the roll units with respect to the travel path is rotated at a lower rotating speed than an upstream one of the roll units.

10 Claims, 3 Drawing Sheets

(56) References Cited

U.S. PATENT DOCUMENTS 2,271,347 A * 1/1942 Runals ..... D21F 5/02 26/105
2,416,027 A * 2/1947 Shields ..... F26B 13/12 226/118.2
3,228,114 A * 1/1966 Smith, Jr. ..... F26B 3/283 34/561
3,230,634 A * 1/1966 Sachs ..... B65H 20/10 226/170
3,403,454 A * 10/1968 Smith, Jr. ..... F26B 3/283 34/635
3,521,375 A * 7/1970 Sanders, Jr. ..... D02J 13/001 34/547
4,619,050 A * 10/1986 Klemm ..... F26B 3/28 34/278
4,738,035 A * 4/1988 Grebe ..... F26B 13/101 34/114
5,609,686 A * 3/1997 Jerry ..... B05C 11/041 118/123
5,820,998 A 10/1998 Hotaling et al.
5,881,476 A * 3/1999 Strobush ..... F26B 13/10 34/210
2003/0110630 A1 6/2003 Onishi et al.
2007/0128368 A1 6/2007 Minamino et al.
2007/0227034 A1* 10/2007 Ogawa ..... F26B 13/10 34/444
2009/0013553 A1* 1/2009 Soltysiak ..... B41F 23/0423 34/459
2010/0247776 A1* 9/2010 Okano ..... F26B 3/02 427/335
2010/0297351 A1* 11/2010 Kida ..... A24C 5/005 427/299
2011/0020565 A1 1/2011 Yasuda et al.
2011/0033624 A1* 2/2011 Tsutsumi ..... D21H 19/824 427/261
2011/0041862 A1* 2/2011 Volgger ..... A24D 1/025 131/365
2012/0090799 A1 4/2012 Kida et al.
2012/0111209 A1 5/2012 Burger
2012/0161058 A1* 6/2012 Albarran ..... E04B 9/001 252/62
2012/0197441 A1* 8/2012 Kim ..... G05B 15/02 700/275
2013/0118510 A1* 5/2013 Kaljura ..... A24D 1/025 131/280

FOREIGN PATENT DOCUMENTS

JP 7-277565 A 10/1995
JP 7-300795 A 10/1995
JP 10-337848 A 12/1998
JP 2003-106767 A 4/2003
JP 2004-290775 A 10/2004
JP 2005-345092 A 12/2005
WO WO 2010-124879 A1 11/2010
WO WO 2011/004460 A1 1/2011

* cited by examiner

DRYING DEVICE AND CIGARETTE WRAPPING PAPER MANUFACTURING MACHINE USING THE DRYING DEVICE

CROSS REFERENCE TO RELATED APPLICATIONS

This application is a Continuation of PCT International Application No. PCT/JP2011/068467 filed on Aug. 12, 2011, which is hereby expressly incorporated by reference in the present application.

TECHNICAL FIELD

The present invention relates to a drying device used in manufacturing, for example, cigarette wrapping paper having a low ignition propensity, and a manufacturing machine using the drying device.

BACKGROUND ART

When wrapping paper for low ignition propensity cigarettes is produced, a web (paper) is applied with a combustion inhibitor. The web is then dried, smoothed to remove wrinkles, and wound into a roll (see Patent Document 1, by way of example). Such drying is carried out using a drying device, and the web dries as it is conveyed at a constant speed through the drying device. However, the web shrinks as it becomes dry, and thus if the web is conveyed at a constant speed, tearing of the web, reduction in the width of the web due to lengthwise pull or formation of fine wrinkles that are difficult to remove is liable to be caused as the web travels downstream.

CITATION LIST

Patent Literature

Patent Document 1: PCT International Publication No. WO/2010/124879

SUMMARY OF INVENTION

Technical Problem

The present invention provides a drying device capable of suppressing tearing of a web and formation of wrinkles in the web, and a cigarette wrapping paper manufacturing machine using the drying device.

Solution to Problem

According to the present invention, there is provided a drying device comprising: a travel path along which a web of paper applied with a coating liquid travels; a plurality of drying ovens arranged side by side along the travel path to dry the web applied with the coating liquid; a plurality of conveyor rolls provided in each of the drying ovens to convey the web along the travel path; a plurality of roll units each constituted by one or more of the conveyor rolls and separated from each other along the travel path; and a plurality of conveyor motors connected to the respective roll units to rotate the conveyor rolls, wherein a downstream one of the roll units with respect to the travel path is rotated at a lower rotating speed than an upstream one of the roll units.

Preferably, the coating liquid is a combustion inhibitor and is applied to a plurality of portions of the web such that the combustion inhibitor-applied portions are regularly spaced in a longitudinal direction of the web and each extend in a width direction of the web.

Preferably, one of the roll units is associated with one of the drying ovens.

Preferably, one of the roll units is associated with two or more of the drying ovens.

Preferably, the roll units include a first block located in an upstream section of the travel path and a second block located downstream of the first block, and the rotating speed of the conveyor rolls of the second block is 97.0% to 99.5% of the rotating speed of the conveyor rolls of the first block.

According to the present invention, there is also provided a cigarette wrapping paper manufacturing machine using the drying device of claim 1, comprising: a supply reel arranged at a starting end of the travel path and configured to supply the web; an applicator device arranged between the supply reel and the drying device and configured to apply the combustion inhibitor which restricts burning of the web; a wrinkle smoothing device arranged downstream of the drying device and configured to smooth out wrinkles in the web; and a take-up reel arranged at a terminating end of the travel path and configured to wind the web thereon.

Advantageous Effects of Invention

According to the present invention, tearing of the web and formation of wrinkles in the web can be suppressed.

DESCRIPTION OF EMBODIMENTS

Figure 1:
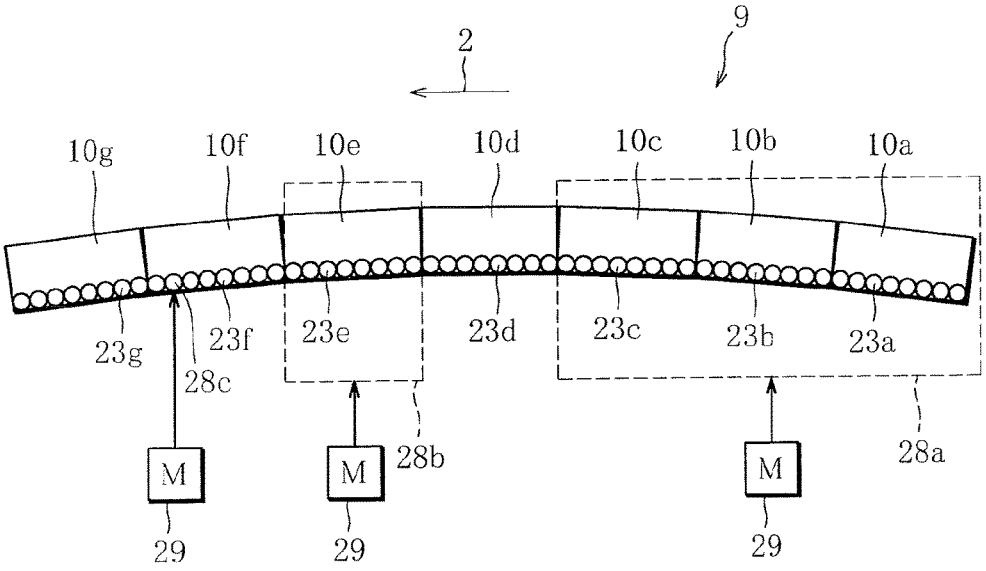
FIG. 1 schematically illustrates a drying device according to one embodiment of the present invention.

As illustrated in FIG. 1, a drying device 9 according to the present invention has a travel path 2 along which a web W of paper is conveyed, as indicated by an arrow in FIG. 1. For the web W, paper having a basis weight in a range from 20 to 60 g/m$^2$, more particularly, paper having a basis weight in a range from 20 to 30 g/m$^2$, is often used. The drying device 9 includes a plurality of drying ovens 10 (in FIG. 1, seven drying ovens 10*a* to 10*g*) arranged side by side along the travel path 2. While passing through the drying ovens, the web W is heated and dried. The drying ovens 10*a* to 10*g* are provided therein with respective conveyor roll assemblies 23*a* to 23*g*, each assembly including a plurality of conveyor rolls for conveying the web W along the travel path 2 (in the example illustrated in FIG. 1, each of the conveyor roll assemblies 23*a* to 23*g* associated with the respective drying ovens 10*a* to 10*g* includes eight conveyor rolls). Adjacent ones of the drying ovens 10 are juxtaposed at a small angle with respect to each other such that the drying ovens as a whole are arranged in an arc (arch). By arranging the drying ovens 10 in an arch, it is possible to control the traveling speed of the web W only through adjustment of the speed of the conveyor rolls 23, as distinct from a drying device which is configured, for example, such that the web W is caused to descend in the middle while traveling through the drying device. The traveling speed of the web W can therefore be controlled appropriately in accordance with shrinking of the web W by changing only the rotating speed of the conveyor rolls 23.

Of the conveyor rolls 23, one or more conveyor rolls along the travel path 2 are grouped to form a roll unit. That roll unit may be constituted by a single conveyor roll 23 or a plurality of consecutive conveyor rolls 23 along the travel path 2. For example, the roll unit is associated with a plurality of drying ovens 10 (roll unit 28*a* in FIG. 1). The roll unit may alternatively be associated with a single drying oven 10 (roll unit 28*b* in FIG. 1). Further, the roll unit may be a single conveyor roll 23 (roll unit 28*c* in FIG. 1). Thus, the drying device 9 is provided with roll units each including one or more conveyor rolls 23. The drying device 9 may be provided with the above combination of roll units 28*a* to 28*c*.

The roll units are connected to respective conveyor motors 29. The conveyor rolls 23 are rotated by the outputs of the conveyor motors 29. As the conveyor rolls 23 rotate, the web W is conveyed from an upstream side to a downstream side of the travel path. Since the conveyor motors 29 are provided for the respective roll units, the rotating speed of the conveyor rolls 23 can be adjusted separately for the individual roll units, whereby the tension of the web W traveling along the travel path 2 can be kept properly. Consequently, the web W can be prevented from being torn or wrinkled. Specifically, while passing through the drying device 9, the web W dries and shrinkage thereof progresses, and thus, if the traveling speed of the downstream section of the drying device 9 is equal to that of the upstream section of same, the tension acting upon the web W increases as the web W travels downstream. By making the rotating speed of downstream-side conveyor rolls 23 lower than that of upstream-side conveyor rolls 23, it is possible to reduce the tension acting upon the web W, whereby the above advantageous effect can be achieved.

The following describes the case where the aforementioned drying device 9 is applied to a manufacturing machine for manufacturing cigarette wrapping paper.

Figure 2:
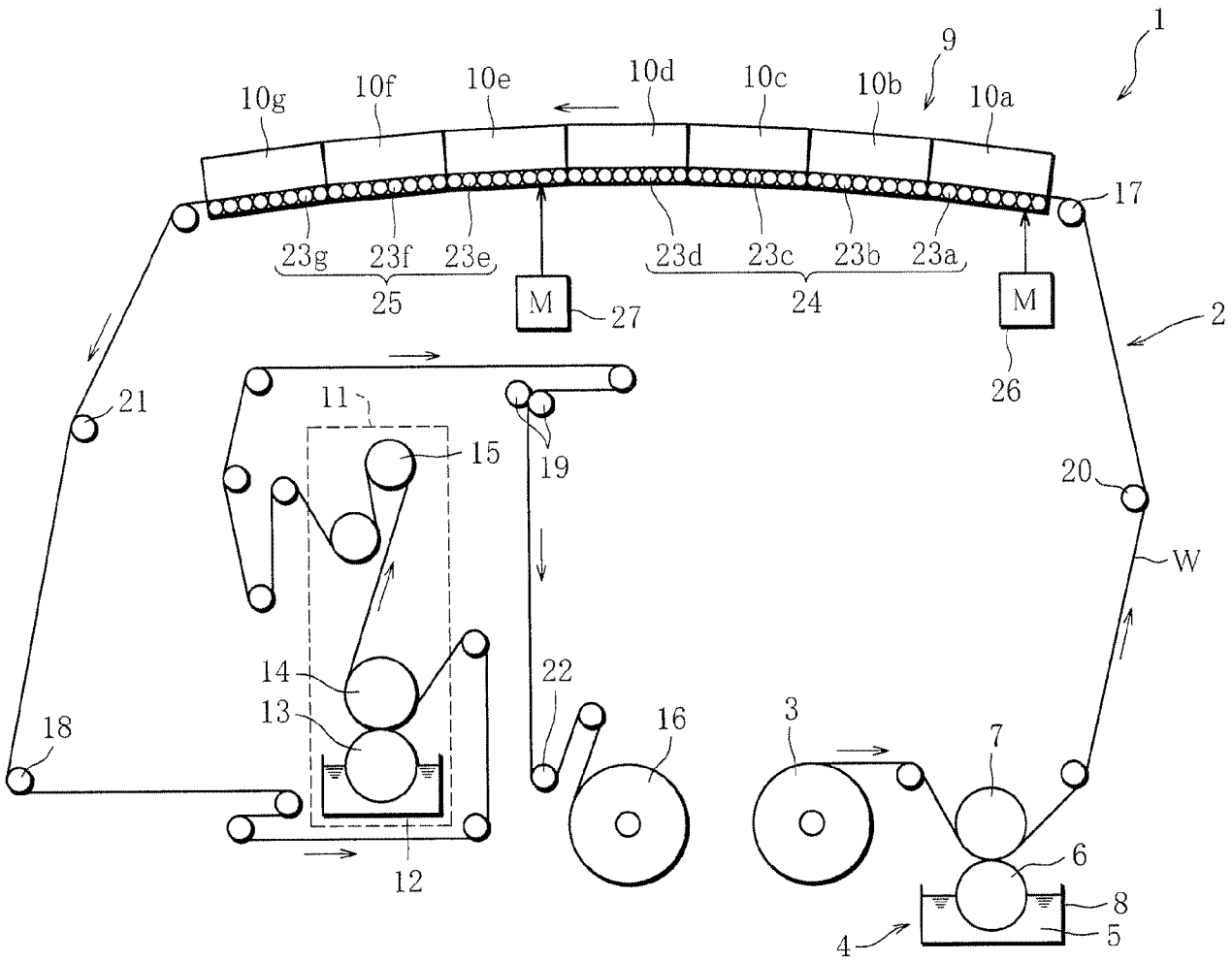
FIG. 2 schematically illustrates a cigarette wrapping paper manufacturing machine according to one embodiment of the present invention.
Figure 3:
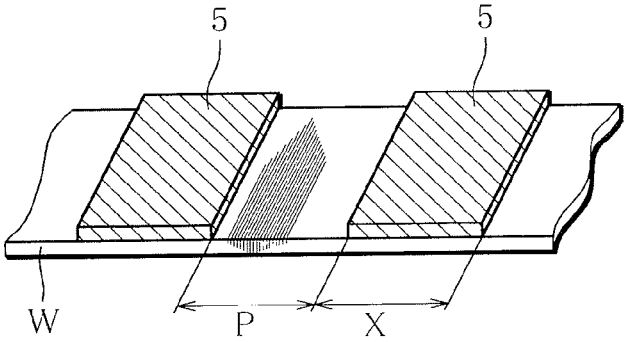
FIG. 3 schematically illustrates a web applied with a combustion inhibitor.

As illustrated in FIG. 2, a cigarette wrapping paper manufacturing machine 1 according to the present invention has the travel path 2 along which the web W of paper is conveyed, as indicated by arrows in the figure. A supply reel 3 is arranged at the starting end of the travel path 2. The supply reel 3 has an original paper roll from which the web W is delivered. The web. W, which is wound onto the supply reel 3, is fed to the travel path 2 from the supply reel 3. An applicator device 4 is arranged downstream of the supply reel 3. The applicator device 4 applies a combustion inhibitor 5 (see FIG. 3), such as an aqueous solution of pectin or an aqueous solution of sodium alginate, to portions of the web W. The applicator device 4 includes a gravure roll 6 and a press roll 7. The web W is caused to pass between the gravure roll 6 and the press roll 7. The gravure roll 6 has part thereof immersed in the combustion inhibitor 5 stored in a container 8, and as the gravure roll 6 rotates, the combustion inhibitor 5 is applied to the web W in contact with the gravure roll 6. The combustion inhibitor 5 serves to restrict burning of the web. Specifically, the combustion inhibitor 5 is applied to a plurality of portions of the web W such that the inhibitor-applied portions are regularly spaced from each other in the longitudinal direction of the web W and each extend in the width direction of the web W. That is, bands of the combustion inhibitor 5 are formed on the web W by the gravure roll 6, as shown in FIG. 3. The length X of each band of the combustion inhibitor 5 in the traveling direction of the web W is 5 mm to 7 mm. The spacing P between adjacent bands of the combustion inhibitor 5 is 17 mm to 20 mm. Thus, the web W to which the present invention is applied is so fragile that the combustion inhibitor 5 should not be applied to the entire surface of the web W. Accordingly, adjustment of the tension of the web, explained below, is of great importance.

After leaving the applicator device 4, the web W travels along the travel path 2 and passes through the aforementioned drying device 9. The drying device 9 is arranged downstream of the applicator device 4 and dries the web W applied with the combustion inhibitor 5. The temperature of hot blasts used for drying the web is, for example, about 150° C., and the interior temperature of the drying ovens 10*a* to 10*g* is, for example, about 130° C.

Also, the feed speed of the web W within the drying device 9 is adjusted, for example, to around 150 m/min.

The web W dried in the drying device 9 then passes through a wrinkle smoothing device 11. The wrinkle smoothing device 11 is arranged downstream of the drying device 9 to smooth out wrinkles in the web W. Specifically, in order to wet the web W first, the web W is caused to travel along a gravure roll 13 which is partly immersed in water stored in a container 12. At this time, the web W is brought into contact with the gravure roll 13 by a press roll 14. Then, the web W is heated and at the same time is smoothed by Yankee dryers 15. In this embodiment, two Yankee dryers 15 are used, and their rotating speeds can be controlled independently of each other. After the wrinkles are smoothed out, the web W travels along the travel path 2 and is wound onto a take-up reel 16 located at the terminating end of the travel path 2.

The conveying speed at which the web W is conveyed through the drying device 9 and which is determined by the rotating speed of the conveyor roll assemblies 23*a* to 23*g* for transferring the web W is not uniform throughout the drying ovens 10*a* to 10*g*. Inside the drying device 9, the web W shrinks as it dries, as stated above. Thus, if the web W is conveyed at a uniform speed throughout the drying ovens 10*a* to 10*g*, tearing of the web W, reduction in the width of the web W due to lengthwise pull acting upon the web W or the formation of fine wrinkles that are difficult to remove may possibly occur as the web W travels toward the downstream section of the drying device 9. To avoid such inconveniences, it is preferable that the conveying speed at which the web W is conveyed through the drying device 9 should be appropriately controlled.

Specifically, the rotating speed of the conveyor rolls of the drying ovens located in the downstream section of the drying device 9 is made lower than that of the conveyor rolls of the drying ovens located in the upstream section of the drying device 9, whereby the tension of the web W can be mitigated, solving the above problem. For example, as illustrated in FIG. 2, an upstream-side first block 24 and a downstream-side second block 25 are set as the aforementioned roll units. The first block 24 includes the drying ovens 10*a* to 10*d*, and the second block 25 includes the drying ovens 10*e* to 10*g*. Conveyor motors 26 and 27, each being a drive source for the conveyor rolls in the drying ovens, are provided for the respective blocks 24 and 25. For the conveyor motors 26 and 27, servomotors may be used. The outputs of these conveyor motors are set in such a manner that the number of rotations per unit time of the conveyor roll assemblies 23*e* to 23*g* of the drying ovens 10*e* to 10*g* belonging to the second block 25 is smaller than the number of rotations per unit time of the conveyor roll assemblies 23*a* to 23*d* of the drying ovens 10*a* to 10*d* belonging to the first block 24. For example, where the number of rotations per unit time of the conveyor roll assemblies 23*a* to 23*d* is reckoned as 100%, the number of rotations per unit time of the conveyor roll assemblies 23*e* to 23*g* is set to 97.0% to 99.5%, preferably, 98.0% to 99.0%. As a result, excessive tension does not act upon the web W passing through the downstream-side second block 25, whereby tearing of the web W and the like can be prevented from being caused in the drying device 9. Especially in the case where the path for drying is long with many drying ovens installed, it is important to divide the drying device 9 into multiple blocks and to set the conveying speeds of the respective blocks appropriately so that the web W can be properly conveyed. If, under the influence of a first adjustment roll 17 described below, there is a slack in the web W entering the drying device 9, the rotating speed of the conveyor roll assemblies 23*a* to 23*d* of the first block 24 may be increased to eliminate the slack. In such a case, the rotating speed of the conveyor roll assemblies 23*a* to 23*d* may be automatically controlled in conjunction with the rotating speed of the first adjustment roll 17.

The manufacturing machine 1 of the present invention further includes first, second and third adjustment rolls 17, 18 and 19 arranged, respectively, between the applicator device 4 and the drying device 9, between the drying device 9 and the wrinkle smoothing device 11, and between the wrinkle smoothing device 11 and the take-up reel 16. The adjustment rolls 17 to 19 are provided to adjust the tension of the web W appropriately in respective sections of the manufacturing machine 1.

The first adjustment roll 17 will be explained first. The web W passes the section between the applicator device 4 and the drying device 9 of the manufacturing machine 1 immediately after the combustion inhibitor 5 is applied to the web W by the applicator device 4, so that the strength of the web W is low. Thus, if excessive tension acts upon the web W located in this section, the web W is torn. However, if the tension is too low, then the web meanders. Especially in the case where the web W is applied with bands of the combustion inhibitor 5 as stated above, it is often the case that the spacing between the bands is inspected using an optical sensor, and if the web W slackens while traveling, the position of the web W relative to the sensor changes, possibly exerting an adverse influence on the inspection results of band spacing. Accordingly, using the first adjustment roll 17, the tension of the web W in the section of the travel path 2 between the applicator device 4 and the drying device 9 is kept at a proper value. Specifically, the rotating speed of the first adjustment roll 17 relative to that of the gravure roll 6 of the applicator device 4 is adjusted to control the tension of the web W in this section of the travel path independently of the other sections. This makes it possible to prevent the web W from being torn in the section between the applicator device 4 and the drying device 9 and also to reduce the occurrence of slackening of the traveling web W. Where a suction roll is used as the first adjustment roll 17, the tension of the web W can be more easily adjusted by controlling the rotating speed of the suction roll to which the web W is attracted by suction. Also, in the section between the applicator device 4 and the drying device 9, the web W needs to be guided to the drying device 9, and therefore, there are many restrictions on the route of travel of the web W. Since a suction roll is capable of adjusting the tension of the web W without the need to bend the web W at a great angle, the use of a suction roll is particularly suited for this section of the travel path. The sucking force of the suction roll may be variably controlled by inverter control or the like. The surface of the suction roll is preferably coated with a thermosetting silicon-based polymer or a fluorine-based polymer.

Further, the first adjustment roll 17 is arranged on one side of the web W opposite the side to which the combustion inhibitor 5 has been applied. Accordingly, the first adjustment roll 17 comes into contact with the side of the web W opposite the side on which the combustion inhibitor 5 exists. Thus, although the web W comes into contact with the first adjustment roll while traveling, the combustion inhibitor 5 is not affected at all. The first adjustment roll 17 is arranged at a location of the travel path 2 immediately in front of the drying device 9.

To enable the first adjustment roll 17 to apply proper tension to the web W, a first pick-up roll 20 is arranged between the applicator device 4 and the first adjustment roll 17. The first pick-up roll 20 measures the tension of the web W to which the combustion inhibitor 5 has been applied by the applicator device 4. The tension of the web W measured by the first pick-up roll 20 is fed back to the first adjustment roll 17, which then changes its rotating speed or the like so that proper tension may be applied to the web W. Consequently, the tension of the web W can be kept constant without causing tearing of the web W applied with the combustion inhibitor 5.

The second adjustment roll 18 will now be explained. The second adjustment roll 18 applies proper tension to the web W that is present in and delivered from the drying device 9, to prevent the web W from being torn within the drying device 9. The tension of the web W within the drying device 9, adjusted by the second adjustment roll 18, is set to a level such that the fine adjustment of the tension of the web W by means of the speed difference between the aforementioned multiple roll units is not affected. Although a suction roll can be used as the second adjustment roll 18 like the first adjustment roll 17, an ordinary roll may be used in such a way that the web W bends at an angle of 90° or more while traveling along the roll. In the section between the drying device 9 and the wrinkle smoothing device 11, there is no restriction on the route of travel of the web W, and also since sufficient space is available, such routing of the web W that the web W bends at an angle of 90° or more is suited for this section. The web W traveling in this section has undulations and wrinkles formed during the drying process, and therefore, it is not advisable to use a type of rolls that hold the web W therebetween, like nip rolls, for the adjustment of the tension because such rolls intensify the wrinkles. By using the second adjustment roll 18 explained above, it is possible to appropriately adjust the tension of the web W within the drying device 9. Specifically, the rotating speed of the second adjustment roll 18 relative to that of the first adjustment roll 17 is adjusted to control the tension of the web W in this section of the travel path independently of the other sections. This makes it possible to prevent the web W from being torn due to excessive tension applied thereto and further to reduce meandering of the web W due to insufficient tension.

Also, to enable the second adjustment roll 18 to apply proper tension to the web W, a second pick-up roll 21 is arranged between the drying device 9 and the second adjustment roll 18. The second pick-up roll 21 measures the tension of the web W that has been dried in the drying device 9. The tension of the web W measured by the second pick-up roll 21 is fed back to the second adjustment roll 18, which then changes its rotating speed or the like so that proper tension may be applied to the web W. Consequently, the tension of the web W can be kept constant without causing tearing of the web W inside the drying device. For the first to third pick-up rolls 20 to 22, load cells may be used, for example.

The third adjustment rolls 19 will now be explained. The third adjustment rolls 19 are provided to appropriately adjust the tension of the web W brought into contact with the downstream-side Yankee dryer 15 of the wrinkle smoothing device 11. Thus, with the wrinkles properly evened out, the web W can be brought into close contact with the surface of the Yankee dryer 15. Specifically, the rotating speed of the third adjustment rolls 19 relative to that of the downstream-side Yankee dryer 15 is adjusted to control the tension of the web W in this section of the travel path independently of the other sections. In the section of the travel path where the third adjustment rolls 19 are arranged, that is, in the section between the wrinkle smoothing device 11 and the take-up reel 16, the web W is free from wrinkles. For the third adjustment rolls 19, therefore, nip rolls capable of holding the web W therebetween are preferably used for the adjustment of the tension of the web W.

The manufacturing machine 1 is provided further with the third pick-up roll 22. The third pick-up roll 22 is provided between the third adjustment rolls 19 and the take-up reel 16 and measures the tension of the web W wound onto the take-up reel 16. As the web W is wound onto the take-up reel 16, the diameter of the take-up reel 16 with the web W thereon increases. If the rotating speed of the take-up reel 16 is fixed despite the increase in the diameter, the web W is wound onto the reel 16 at a gradually increasing speed and the tension of the web W tends to increase. Thus, the tension of the web W is measured and change in the tension is fed back to the take-up reel 16, so that the rotating speed of the take-up reel 16 may be lowered to maintain proper tension of the web W. It is therefore possible to prevent tearing and the like of the web W being wound onto the take-up reel.

As stated above, in this embodiment, the first, second and third adjustment rolls 17 to 19, each permitting the web W to be applied with different tensions on the upstream and downstream sides of the roll, are arranged respectively between the applicator device 4 and the drying device 9, between the drying device 9 and the wrinkle smoothing device 11, and between the wrinkle smoothing device 11 and the take-up reel 16, so that the tensions of the respective portions of the web W can be adjusted so as to be suited for the individual devices 4, 9 and 11. Thus, although the web W is applied with the combustion inhibitor 5 in process of manufacture, tearing of the web W and formation of wrinkles can be suppressed and the tension of the web W can be kept appropriately so as to suit the individual processes. Also, tearing of the web W accompanying the drying and consequent shrinkage of the web W within the drying device 9 can be suppressed through the fine adjustment of the tension of the web W by means of the speed difference between the multiple roll units.

The aforementioned first and second pick-up rolls 20 and 21 are arranged at locations where the web W travels in a vertical direction. By arranging the rolls 20 and 21 at such locations, it is possible to reduce the size of the manufacturing machine 1.

A manufacturing method described below can be implemented by using the cigarette wrapping paper manufacturing machine 1 explained above.

First, a supply process is performed to supply the web W from the supply reel 3 to the travel path 2. An application process is then performed using the applicator device 4, to apply the web W with the combustion inhibitor 5. Subsequently, a first tension adjustment process is performed using the first adjustment roll 17, in order to maintain proper tension of the web W located between the applicator device 4 and the drying device 9. In this process, feedback control using the first pick-up roll 20 is executed by measuring the tension of the web W applied with the combustion inhibitor 5 and, based on the measurement result, adjusting the tension of the web W by means of the first adjustment roll 17.

Then, a drying process is performed to dry the web W in the drying device 9. Subsequently, a second tension adjustment process is performed using the second adjustment roll 18, in order to maintain proper tension of the web W located between the drying device 9 and the wrinkle smoothing device 11. In this process, feedback control using the second pick-up roll 21 is executed by measuring the tension of the web W dried by the drying process and, based on the measurement result, adjusting the tension of the web W by means of the second adjustment roll 21.

A wrinkle smoothing process is then performed using the wrinkle smoothing device 11, to smooth out wrinkles in the web W. Subsequently, a third tension adjustment process is performed using the third adjustment rolls 19, in order to maintain proper tension of the web W located between the wrinkle smoothing device 11 and the take-up reel 16. A take-up process is then performed to wind the web W onto the take-up reel 16. In the take-up process, the tension of the web W before being wound onto the take-up reel 16 is measured, and based on the measurement result, the rotating speed of the take-up reel 16 is adjusted.

REFERENCE SIGNS LIST

1: cigarette wrapping paper manufacturing machine
2: travel path
3: supply reel
4: applicator device
5: combustion inhibitor
6: gravure roll
7: press roll
8: container
9: drying device
10*a* to 10*g*: drying oven
11: wrinkle smoothing device
12: container
13: gravure roll
14: press roll
15: Yankee dryer
16: take-up reel
17: first adjustment roll
18: second adjustment roll
19: third adjustment rolls
20: first pick-up roll
21: second pick-up roll
22: third pick-up roll
23*a* to 23*g*: conveyor roll
24: first block
25: second block
26: conveyor motor
27: conveyor motor
28*a* to 28*c*: roll unit
29: conveyor motor
W: web

The invention claimed is:

1. A drying device comprising:

a travel path along which a web of paper, applied on one side of the web with a coating liquid by an applicator device, travels, said travel path including an arch section having an upwardly convex configuration with an upstream end and a downstream end; and a dryer arranged above the arch section of the travel path of the web for drying the web applied with the coating liquid, said dryer including:

an inlet arranged at the upstream end of the arch section;

an outlet arranged at the downstream end of the arch section;

a plurality of drying ovens arranged side by side along the arch section of said travel path, the drying ovens being adjacent to each other;

a plurality of conveyor rolls provided in each of said drying ovens to define the arch section of said travel path and to convey the web along the arch section of said travel path while supporting the other side of the web without coming in contact with the coating liquid on the web;

a plurality of roll units each constituted by one or more of said conveyor rolls and separated from each other along the arch section of said travel path; and a plurality of conveyor motors connected to said respective roll units to rotate said conveyor rolls, wherein a downstream one of said roll units with respect to the arch section of said travel path is rotated at a lower rotating speed than an upstream one of said roll units, wherein the travel path includes a first adjustment roll arranged immediately upstream of the inlet of said dryer, the first adjustment roll being adapted to vary a first tension of the applied web between the applicator device and the dryer in accordance with a measurement result of the first tension of the applied web, and a first pick-up roll arranged between the applicator device and the first adjustment roll for picking up the first tension of the applied web while guiding the applied web, the guide roll and the first adjustment roll allowing the applied web travelling from the applicator device to the inlet of said dryer (i) to be supported only on the other side of the applied web and (ii) to be bent at most at a bend angle less than 90° with respect to a travel direction of the web over an entire region from the applicator device to the inlet of said dryer, and wherein the travel path further includes a second adjustment roll arranged downstream of the dryer, the second adjustment roll being adapted to vary a second tension of the dried web leaving the dryer in accordance with a measurement result of the second tension of the dried web, and a second pick-up roll arranged between the dryer and the second adjustment roll for picking up the second tension of the dried web while guiding the dried web.

2. The drying device according to claim 1, wherein the coating liquid is a combustion inhibitor and is applied to a plurality of portions of the web such that the combustion inhibitor-applied portions are regularly spaced in a longitudinal direction of the web and each extend in a width direction of the web.

3. The drying device according to claim 2, wherein one of said roll units is associated with one of said drying ovens.

4. The drying device according to claim 3, wherein one of said roll units is associated with two or more of said drying ovens.

5. The drying device according to claim 4, wherein:

said roll units include a first block located in an upstream section of the arch section of the travel path, and a second block located downstream of the first block, and the rotating speed of said conveyor rolls of the second block is 97.0% to 99.5% of the rotating speed of said conveyor rolls of the first block.

6. A cigarette wrapping paper manufacturing machine using the drying device according to claim 2, comprising:

a supply reel arranged at a starting end of said travel path and configured to supply the web;

an applicator device arranged between said supply reel and the drying device and configured to apply the combustion inhibitor which restricts burning of the web;

a wrinkle smoothing device arranged downstream of the drying device and configured to smooth out wrinkles in the web; and a take-up reel arranged at a terminating end of said travel path and configured to wind the web thereon.

7. The drying device according to claim 1, wherein:

the applied coating liquid forms bands on the web, said bands being spaced apart from each other in a longitudinal direction of the web and each extending in a width direction of the web.

8. The drying device according to claim 1, wherein:

said conveyor rolls in each of said drying ovens are consecutively arranged along the arch section of said travel path.

9. The drying device according to claim 1, wherein:

the first adjustment roll is a suction roll, said suction roll guiding the applied web to said dryer while attracting the other side of the applied web by suction.

10. The drying device according to claim 1, wherein the web is directly supported by the plurality of conveyor rolls with no intervening structure.

* * * * *